US011939117B2

(12) United States Patent
Genord et al.

(10) Patent No.: US 11,939,117 B2
(45) Date of Patent: Mar. 26, 2024

(54) SUMP PUMP CROCK

(71) Applicant: Independence Materials Group, LLC, Virginia Beach, VA (US)

(72) Inventors: Robert Genord, Livonia, MI (US); Karl Chapel, Grand Haven, MI (US)

(73) Assignee: Independence Materials Group, LLC, Virginia Beach, VA (US)

( * ) Notice: Subject to any disclaimer, the term of this patent is extended or adjusted under 35 U.S.C. 154(b) by 586 days.

(21) Appl. No.: 17/110,838

(22) Filed: Dec. 3, 2020

(65) Prior Publication Data

US 2021/0163189 A1 Jun. 3, 2021

Related U.S. Application Data

(60) Provisional application No. 62/942,960, filed on Dec. 3, 2019.

(51) Int. Cl.

| | |
|---|---|
| ***B65D 45/22*** | (2006.01) |
| ***E03F 5/22*** | (2006.01) |
| ***F04B 23/02*** | (2006.01) |

(52) U.S. Cl.

CPC ..... *B65D 45/22* (2013.01); *E03F 5/22* (2013.01); *F04B 23/021* (2013.01)

(58) Field of Classification Search

CPC .. B65D 45/22; E03F 5/22; E03F 5/024; F04B 23/021

See application file for complete search history.

(56) References Cited

U.S. PATENT DOCUMENTS

| | | | | |
|---|---|---|---|---|
| 4,863,053 | A * | 9/1989 | Oberg | B65D 45/22 414/407 |
| 4,890,425 | A * | 1/1990 | Mamula | E02D 31/02 52/169.5 |
| 6,276,093 | B1 * | 8/2001 | Janesky | E03F 5/22 52/19 |
| 2017/0016202 | A1 | 1/2017 | Stiatti et al. | |

FOREIGN PATENT DOCUMENTS

EP 2735348 A1 5/2014

OTHER PUBLICATIONS

Independence Materials Group, LLC, International Patent Application No. PCT/US2020/063062, International Preliminary Report on Patentability, dated Jun. 16, 2022.

Foundation Systems of Michigan, International Patent Application No. PCT/US2020/063062, Invitation to Pay Additional Fees, dated Mar. 18, 2021.

Foundation Systems of Michigan, International Patent Application No. PCT/US2020/063062, International Search Report and Written Opinion, dated May 11, 2021.

Independence Materials Group, LLC, Canadian Patent Application No. 3,160,404, Office Action, dated Jan. 8, 2024.

* cited by examiner

*Primary Examiner* — Donnell A Long

(74) *Attorney, Agent, or Firm* — Moore & Van Allen PLLC; Jeffrey R. Gray

(57) ABSTRACT

A sump pump crock includes a body including a first portion and a second portion separate from the first portion. The first portion includes one of a tab and an opening, and the second portion includes the other of the tab and the opening. The tab is received in the opening to secure the first portion to the second portion. The body defines a base, a plurality of sidewalls, and a top opening, and a plurality of flanges extend around an outer perimeter of the body. The sump (Continued)

pump crock includes a removeable lid that covers the top opening.

17 Claims, 12 Drawing Sheets

SUMP PUMP CROCK

REFERENCE TO RELATED APPLICATIONS

This application claims the benefit of U.S. Provisional Application No. 62/942,960 filed Dec. 3, 2019.

BACKGROUND

This disclosure relates to a sump pump crock.

SUMMARY

A sump pump crock includes a body including a first portion and a second portion separate from the first portion. The first portion includes one of a tab and an opening, and the second portion includes the other of the tab and the opening. The tab is received in the opening to secure the first portion to the second portion. The body defines a base, a plurality of sidewalls, and a top opening, and a plurality of flanges extend around an outer perimeter of the body. The sump pump crock includes a removeable lid that covers the top opening.

In an embodiment, the plurality of flanges extend around an external surface of the body and are substantially parallel to the base.

In an embodiment, the plurality of flanges comprise three flanges.

In an embodiment, each of the plurality of flanges has a thickness of approximately 1 inch.

In an embodiment, the body is octagonal in shape.

In an embodiment, at least one of the plurality of sidewalls includes a plurality of perforations.

In another embodiment, the first portion includes a first wall, a second wall connected to the first wall at approximately a 45° angle relative to the first wall, a third wall connected to the first wall at approximately a 45° angle relative to the first wall, a partial fourth wall connected to the second wall at approximately a 45° angle relative to the second wall, and a partial fifth wall connected to the third wall at approximately a 45° angle relative to the third wall. The second portion includes a sixth wall parallel to the first wall, a seventh wall connected to the sixth wall at approximately a 45° angle relative to the sixth wall, an eighth wall connected to the sixth wall at approximately a 45° angle relative to the sixth wall, another partial fourth wall connected to the seventh wall at approximately a 45° angle relative to the seventh wall, and another partial fifth wall connected to the eighth wall at approximately a 45° angle relative to the eight wall.

In another embodiment, one of the partial fourth wall includes one of the tab and the opening and the other of the partial fourth wall includes the other of the tab and the opening that interacts with the one of the tab and the opening to secure the one of the partial fourth wall to the other of the partial fourth wall.

In another embodiment, the one of the partial fourth wall includes three tabs and three openings, and the other of the partial fourth wall includes three tabs and three openings.

In another embodiment, an inside surface of the first wall and an inside surface of the sixth wall of the body each includes a slot that receives a bridge that extends between the first wall and the sixth wall.

In another embodiment, the base comprises a first base part of the first portion and a second base part of the second portion.

In another embodiment, the lid comprises a first lid portion and a second lid portion each including a curved hinge that engages a rod, wherein the curved hinge of the first lid portion engages the rod of the second lid portion, and the curved hinge of the second lid portion engages the rod of the first lid portion, allowing one of the first lid portion and the second lid portion to move relative to the other of the first lid portion and the second lid portion.

In another embodiment, the lid includes a hole that receives a drain that allows for water to flow in one direction through the drain.

A sump pump crock includes a body octagonal in shape including a first portion and a second portion separate from the first portion. The first portion includes one of a tab and an opening and the second portion includes the other of the tab and the opening, and the tab is received in the opening to secure the first portion to the second portion. The body defines a base, a plurality of sidewalls, and a top opening, and a plurality of flanges extend around an outer perimeter of the body, extend around an external surface of the body, and are substantially parallel to the base. At least one of the plurality of sidewalls includes a plurality of perforations. The base includes a first base part of the first portion and a second base part of the second portion. The first base part includes one of a tab and an opening and the second base part includes the other of the tab and the opening that interacts with the one of the tab and the opening of the first base part to secure the first base part to the second base part. The sump pump crock includes a removeable lid that covers the top opening. The lid includes a first lid portion and a second lid portion each including a curved hinge that engages a rod. The curved hinge of the first lid portion engages the rod of the second lid portion, and the curved hinge of the second lid portion engages the rod of the first lid portion, allowing one of the first lid portion and the second lid portion to move relative to the other of the first lid portion and the second lid portion. The lid includes a hole that receives a drain that allows for water to flow in one direction through the drain.

In an embodiment, the first portion includes a first wall, a second wall connected to the first wall at approximately a 45° angle relative to the first wall, a third wall connected to the first wall at approximately a 45° angle relative to the first wall, a partial fourth wall connected to the second wall at approximately a 45° angle relative to the second wall, and a partial fifth wall connected to the third wall at approximately a 45° angle relative to the third wall. The second portion includes a sixth wall parallel to the first wall, a seventh wall connected to the sixth wall at approximately a 45° angle relative to the sixth wall, an eighth wall connected to the sixth wall at approximately a 45° angle relative to the sixth wall, another partial fourth wall connected to the seventh wall at approximately a 45° angle relative to the seventh wall, and another partial fifth wall connected to the eighth wall at approximately a 45° angle relative to the eight wall.

In another embodiment, one of the partial fourth wall includes one of the tab and the opening and the other of the partial fourth wall includes the other of the tab and the opening that interacts with the one of the tab and the opening to secure the one of the partial fourth wall to the other of the partial fourth wall, and wherein the one of the partial fourth wall includes three tabs and three openings, and the other of the partial fourth wall includes three tabs and three openings.

BRIEF DESCRIPTION OF THE DRAWINGS

The various features and advantages will become apparent to those skilled in the art from the following detailed description of the currently preferred embodiment. The drawings that accompany the detailed description can be briefly described as follows.

DETAILED DESCRIPTION

Figure 1:
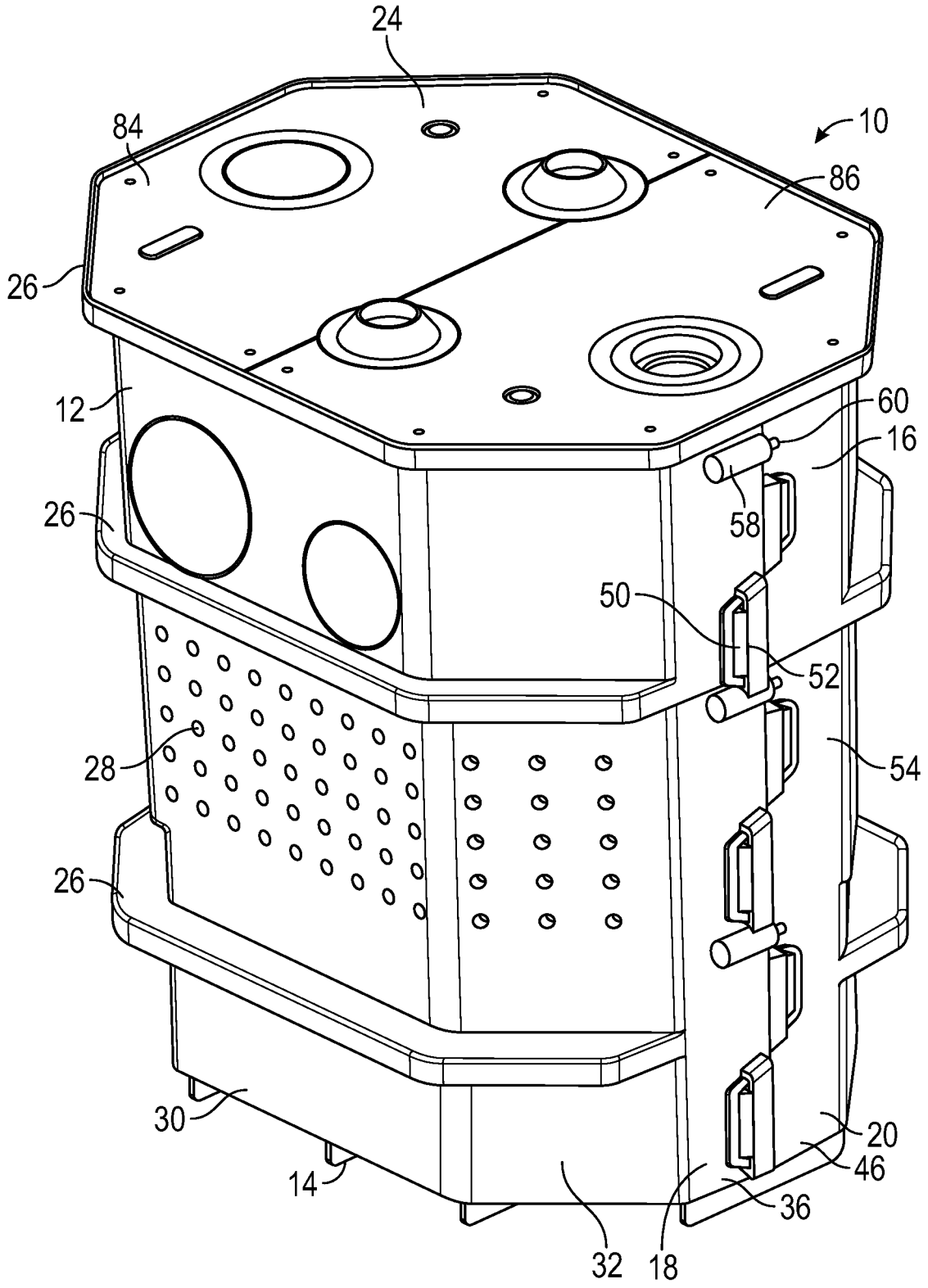
FIG. 1 illustrates a perspective view of a sump pump crock.
Figure 2:
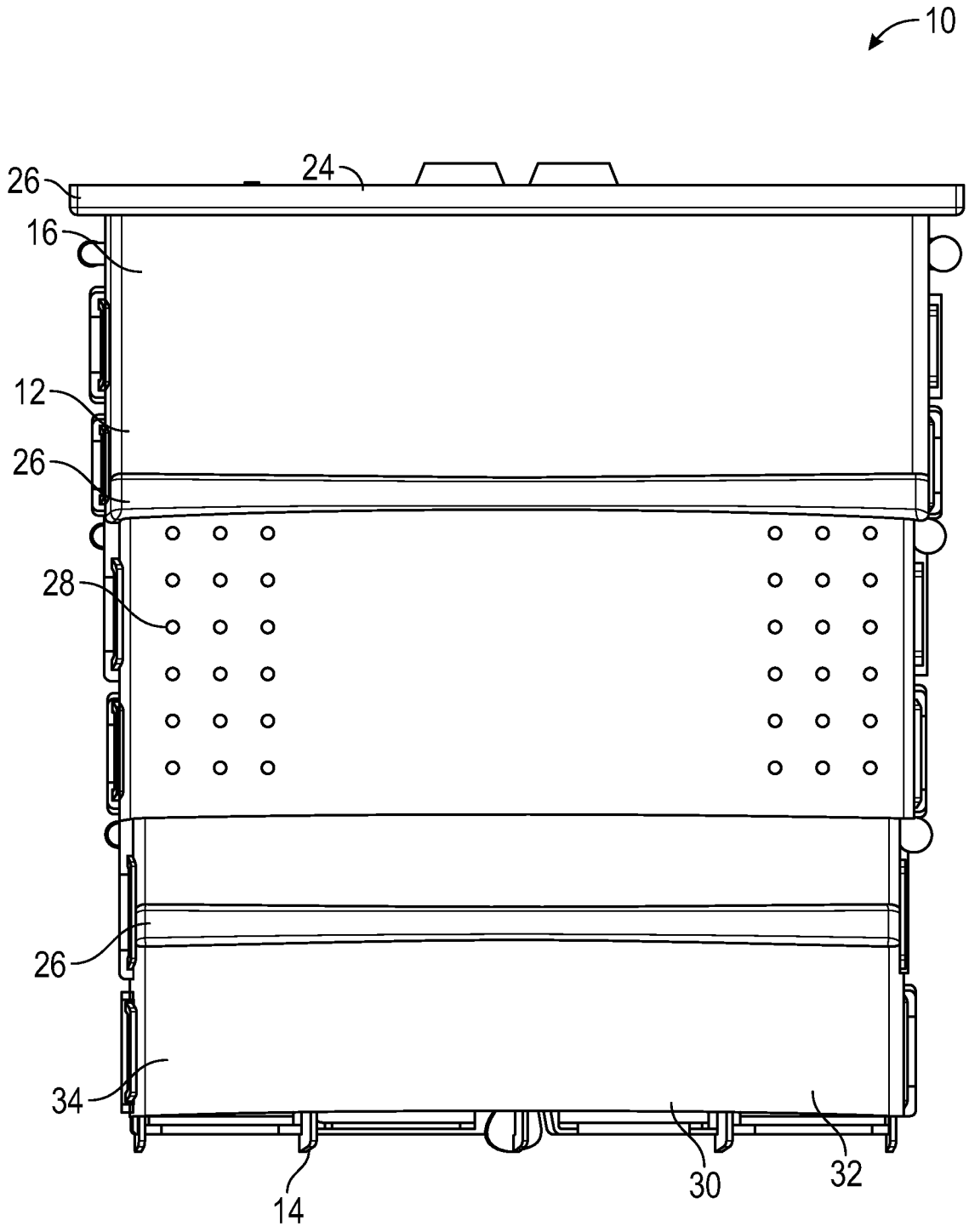
FIG. 2 illustrates a front view of the sump pump crock.
Figure 3:
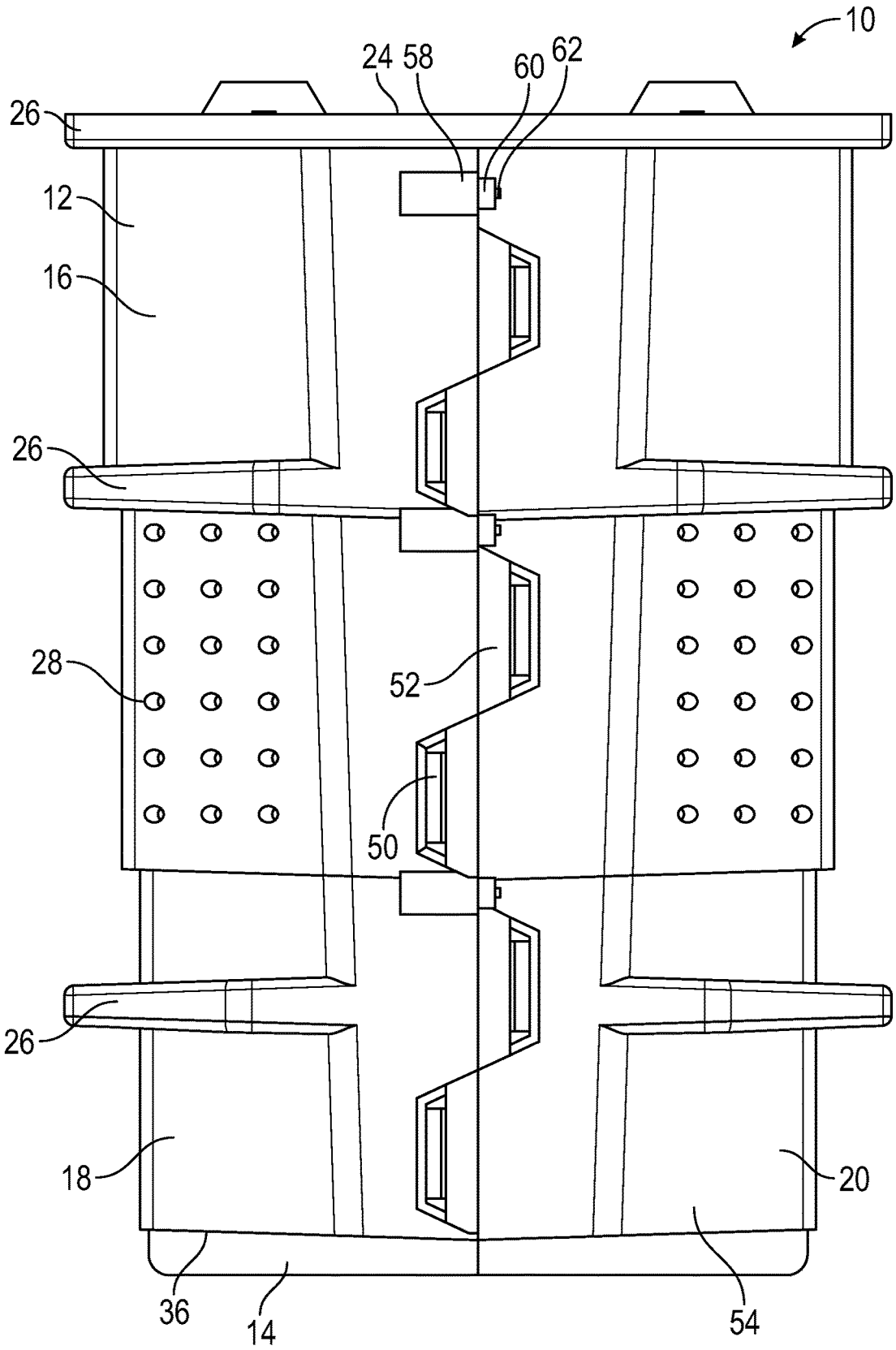
FIG. 3 illustrates a side view of the sump pump crock.

FIGS. 1 to 3 illustrate a sump pump crock 10. The sump pump crock 10 includes a body 12 including a base 14 and side walls 16. The body 12 includes a first portion 18 and a second portion 20 that are connected together to define the sump pump crock 10 to allow the sump pump crock 10 to be installed in very confined substructure areas, such as crawlspaces. For example, the separate components can be carried to a desired location in the crawlspace. Once at the desired location, the first portion 18 and the second portion 20 are attached to form the body 12 and base 14. This allows the sump pump crock 10 to be transported in components to locations that are too tight to receive a one piece sump pump crock.

The sump pump crock 10 includes an opening 22 (shown in FIG. 5), and a lid 24 covers the opening 22. In one example, the body 12 includes eight side walls 16 such that a cross-sectional shape of the body 12 is substantially octagonal. As the body 12 is not round, the flat walls of the body 12 help to withstand hydrostatic and other soil pressures. In one example, the body 12 and lid 24 are made of molded plastic.

The side walls 16 include at least one flange 26 that provide anti-heaving features that withstand frost and other soil pressures and provide structural integrity. In one example, there are three flanges 26 spaced along a height of the body 12. The at least one flange 26 extends around the external surface of the body 12 and are substantially parallel to the base 14.

A top flange 26 defines the opening 22, and a lower surface of the top flange 26 extends approximately 1.75 inch outwardly from an upper portion of the side wall 16. The middle flange 26 has a thickness of approximately 0.75 inch relative to the height and extends approximately 1.75 inch outwardly from an upper portion of the side wall 16 and approximately 1.5 inch from a middle portion of the side wall 16. The lower flange has a thickness of approximately 1.0 inch relative to the height and extends approximately 1.5 inch outwardly from the middle portion of the side wall 16 and approximately 1.75 inch outwardly from a lower portion of the side wall 16. The flanges 26 are roughly spaced equally along the height of the body 12.

The side walls 16 also include a plurality of perforations 28 that are molded into the side walls 16. The perforations 28 allow for the flow of water into and out of the body 12 and help to hold stone and soil for additional stability.

The first portion 18 includes a first wall 30, a second wall 32 connected to the first wall 30 at approximately a 45° angle relative to the first wall 30, and a third wall 34 connected to the first wall 30 at approximately a 45° angle relative to the first wall 30. A partial fourth wall 36 is connected to the second wall 32 at approximately a 45° angle (and approximately perpendicular to the first wall 30), and a partial fifth wall 38 is connected to the third wall 34 at approximately a 45° angle (and approximately perpendicular to the first wall 30).

The second portion 20 includes a sixth wall 40 (parallel to the first wall 30), a seventh wall 42 connected to the first wall 30 at approximately a 45° angle relative to the sixth wall 40 (and approximately parallel to the second wall 32), and an eighth wall 44 connected to the first wall 30 at approximately a 45° angle relative to the sixth wall 40 (and approximately parallel to the third wall 34). A partial fourth wall 46 is connected to the second wall 32 at approximately a 45° angle (and approximately perpendicular to the first wall 30), and a partial fifth wall 48 is connected to the third wall 34 at approximately a 45° angle (and approximately perpendicular to the first wall 30).

The partial fourth wall 36, 38 and the partial fifth wall 46, 48 of both the first portion 18 and the second portion 20, respectively, each include a plurality of alternating tabs 50 and openings 52. Each tab 50 on the partial fourth wall 36 and partial fifth wall 38 of the first portion 18 is received in an opening 22 on the partial fourth wall 46 and partial fifth wall 48, respectively, of the second portion 20. Each tab 50 on the partial fourth wall 46 and partial fifth wall 48 of the second portion 20 is received with an opening 52 on partial fourth wall 36 and partial fifth wall 38, respectively, of the first portion 18.

In one example, there are three tabs 50 and three openings 52 on the partial fourth wall 36 of the first portion 18 that engage with and lock with respect to three tabs 50 and three openings 52 on the partial fourth wall 38 of the second portion 20. There are also three tabs 50 and three openings 52 on the partial fifth wall 46 of the first portion 18 that engage with and lock with respect to three tabs 50 and three openings 52 on the partial fifth wall 48 of the second portion 20.

Figure 4A:
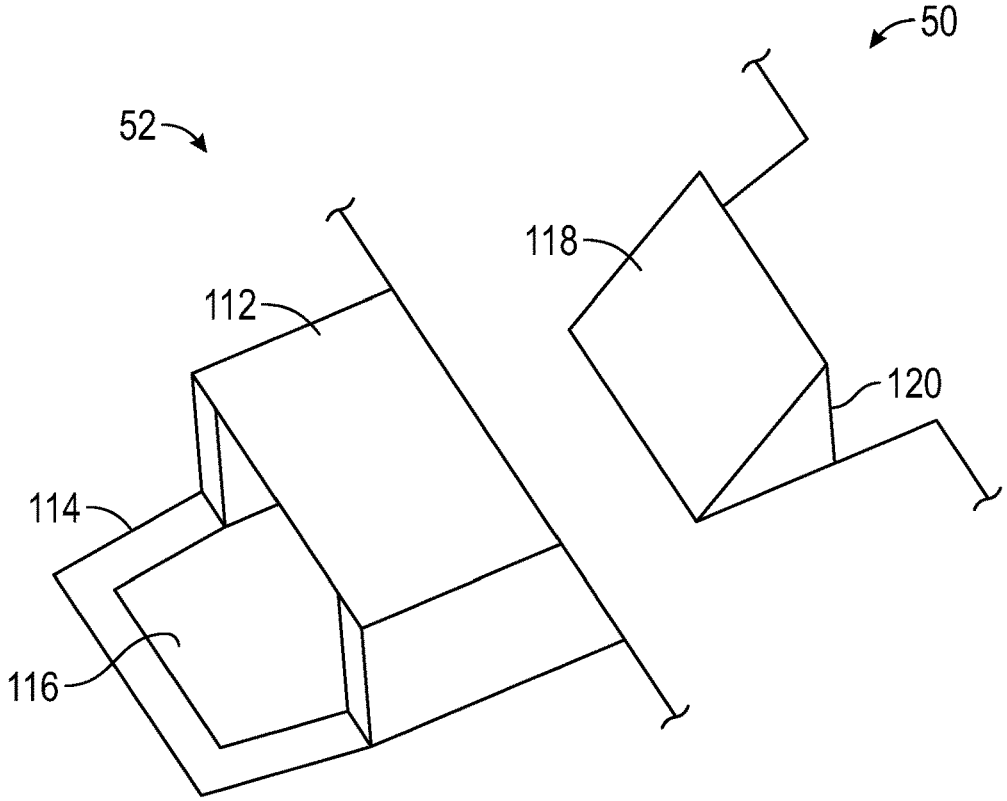
FIG. 4A illustrates a tab and an opening unattached.
Figure 4B:
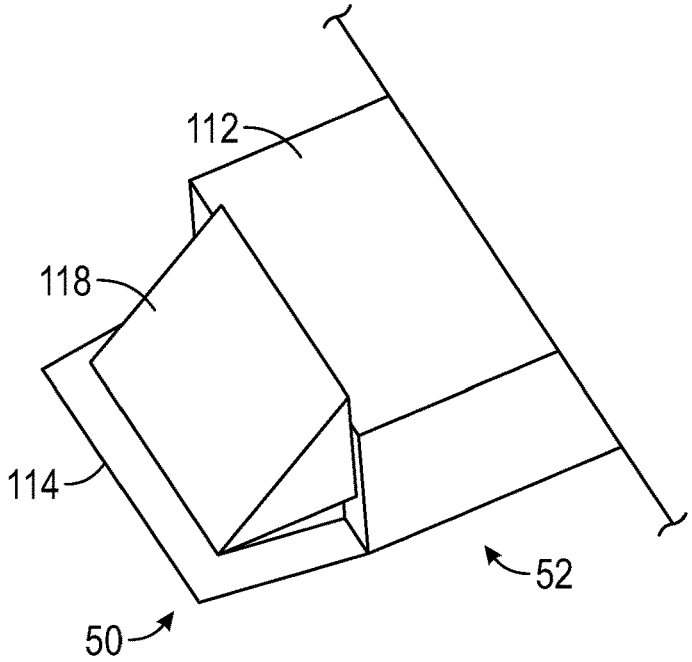
FIG. 4B illustrates the tab and the opening attached.

As shown in FIGS. 4A and 4B, in one example, each tab 50 includes a wall 120 approximately perpendicular to the body 12 and a raised inclined portion 118 that defines a latch. As shown in FIG. 4A, each opening 52 is defined by a bracket 112 having a spaced ledge 114 that defines a space 116 in which the tab 50 is received. During insertion, the raised inclined portion 118 of the tab 50 is pressed underneath the bracket 112, compressing the raised inclined portion 118 of the tab 50. As shown in FIG. 4B, once the tab 50 passes under the bracket 112 that defines the opening 52, the compression on the raised inclined portion 118 of the tab 50 is released. The tab 50 is received in the space 116 defined by the ledge 114, and the wall 120 of the tab 50 engages a side of the bracket 112, securing the first portion 18 to the second portion 20. Each tab 50 and opening 52 pair is attached in this manner. The first portion 18 and the second portion 20 can also be detached from each other by pressing on the tab 50 to allow the tap 50 to slide in the opening 52.

When attached, the partial fourth wall 36 of the first portion 18 and the partial fourth wall 46 of the second portion 20 define a fourth wall 54, and the partial fifth wall 46 of the first portion 18 and the partial fifth wall 48 of the second portion 20 define the fifth wall 56. The fourth wall 54 is parallel to the fifth wall 56.

The first portion 18 and the second portion 20 each include a plurality of aligned tubes 58 and 60, respectively. A threaded fastener 62, such as a screw, is received in each set of aligned tubes 58 and 60 to secure the first portion 18 and the second portion 20 together.

Figure 5:
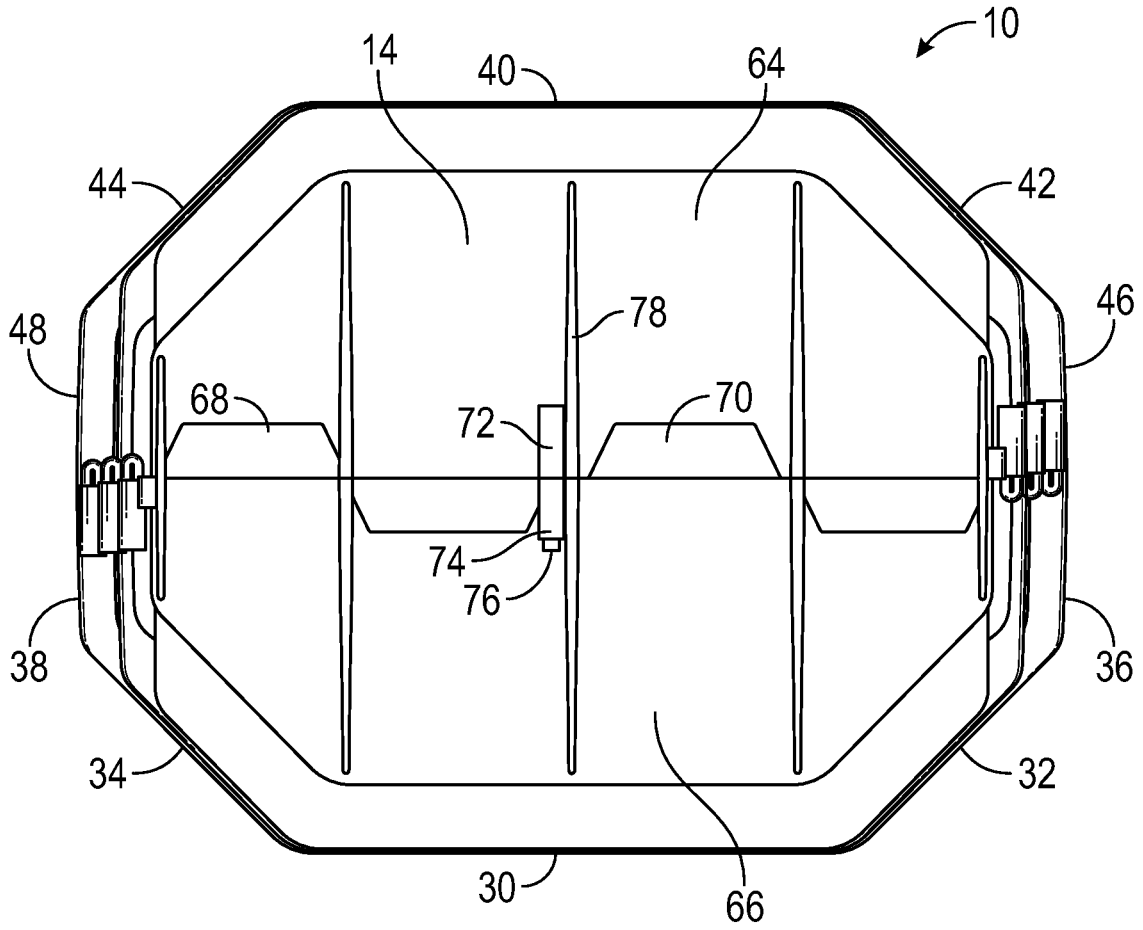
FIG. 5 illustrates a bottom view of a base of the sump pump crock.

As shown in FIG. 5, the first portion 18 includes a first base part 64, and the second portion 20 includes a second base part 66. The first base part 64 and the second base part 66 each include a plurality of alternating tabs 68 and openings 70. Each tab 68 on the first base part 64 is received in one of the openings 70 on the second base part 66, and each tab 68 on the second base part 66 is received in one of the openings 70 on the first base part 64. The tabs 68 and the openings 70 are attached as described above with respect to FIGS. 4A and 4B.

In one example, each tab 68 includes a wall approximately perpendicular to the base 14 and a raised inclined portion that defines a latch. Each opening 70 is defined by a bracket having a spaced ledge that defines a space in which the tab 68 is received. During insertion, the raised inclined portion of the tab 68 is pressed underneath the bracket, compressing the raised inclined portion of the tab 68. Once the tab 68 passes under the bracket that defines the opening 70, the compression on the raised inclined portion of the tab 68 is released. The tab 68 is received in the space defined by the ledge, and the wall of the tab 68 engages a side of the bracket, securing the first base part 64 to the second base part 66 to define the base 14. Each tab 68 and opening 70 pair is attached in this manner.

The first base part 64 and the second base part 66 each include an aligned tube 72, 74, respectively. A threaded fastener 76, such as a screw, is received in the aligned tubes 72, 74 to secure the first base part 64 and the second base part 66 together. The base 14 includes a plurality of flanges 78. In one example, the flanges 78 are substantially parallel and extend between the first wall 30 and the sixth wall 40.

Figure 6:
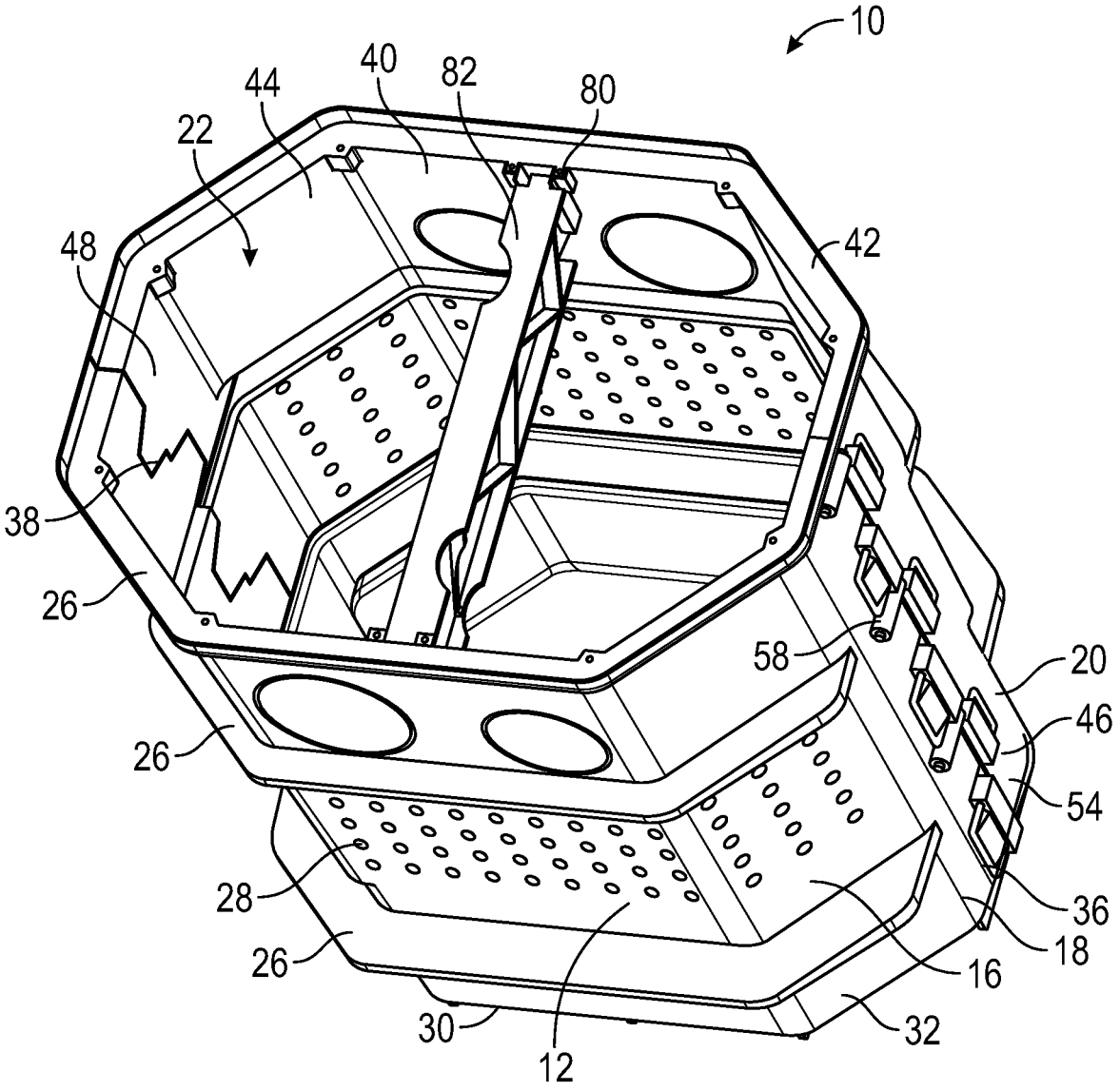
FIG. 6 illustrates a perspective view of an inside of the sump pump crock including a bridge.
Figure 7:
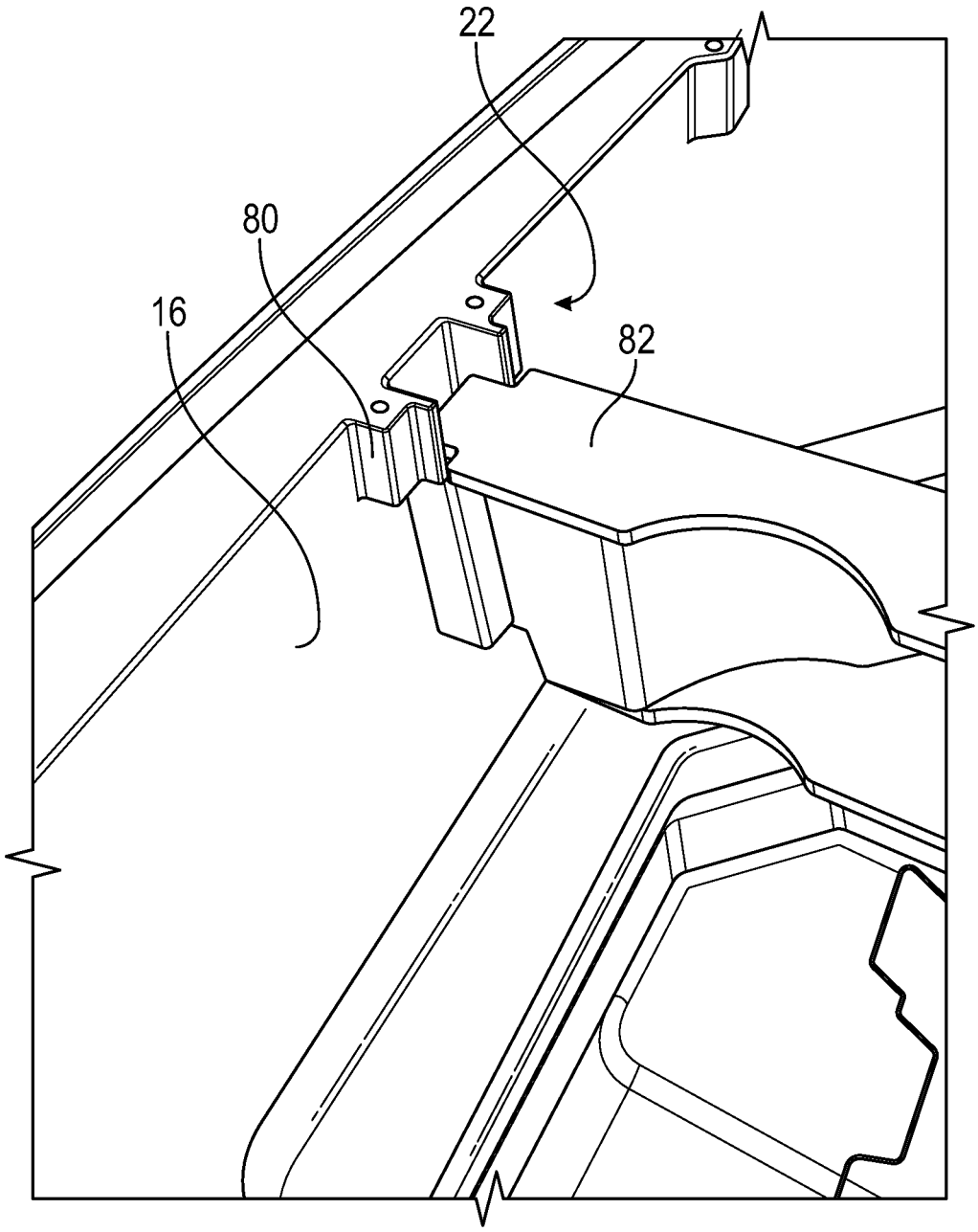
FIG. 7 illustrates a perspective view of a slot of the sump pump crock that retains the bridge.

As shown in FIGS. 6 and 7, an inside surface of the first wall 30 and an inside surface of the sixth wall 40 each includes a slot 80 that receives a bridge 82 that extends between the first wall 30 and the sixth wall 40. The bridge 82 increases the strength of the sump pump crock 10.

Figure 8:
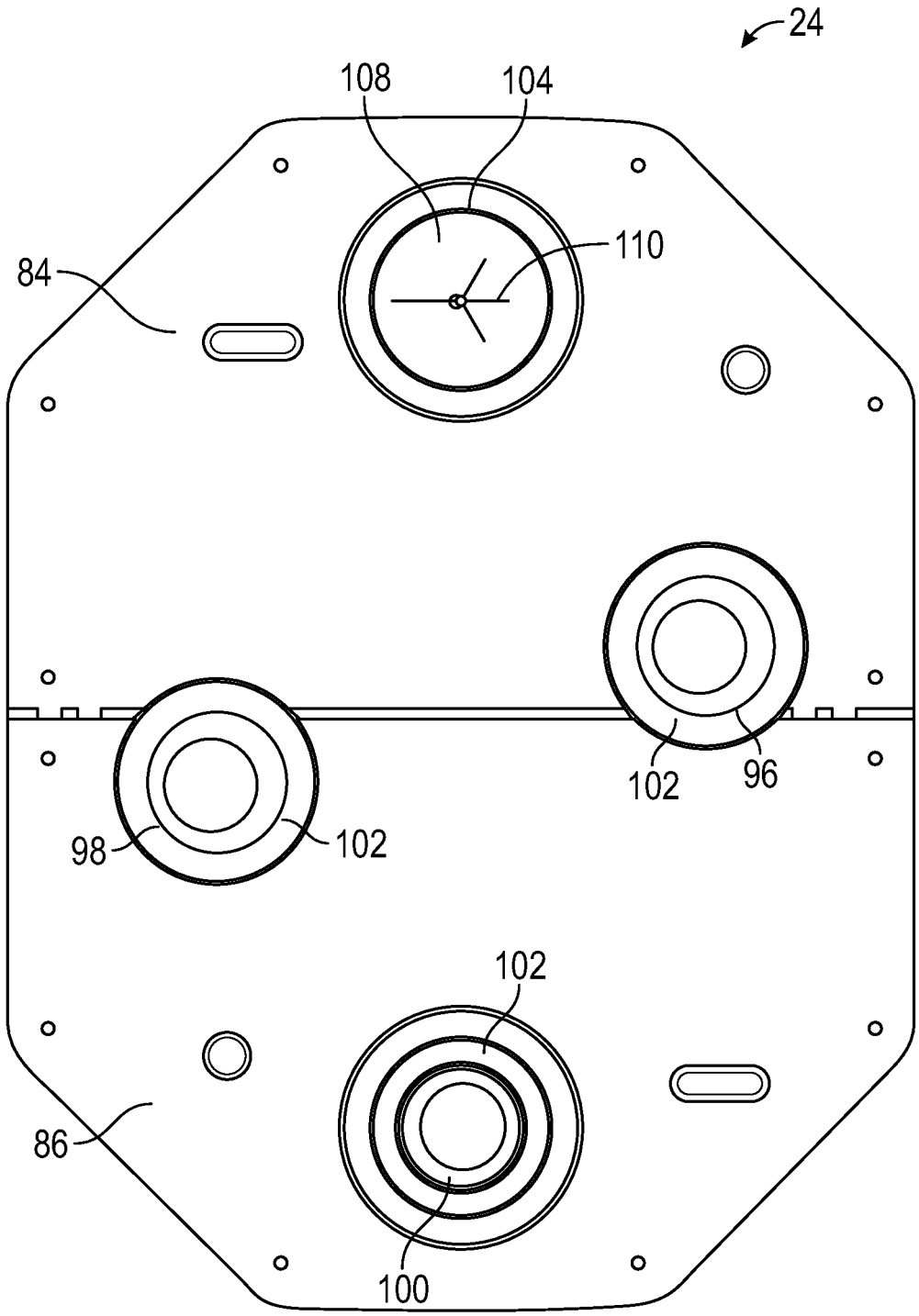
FIG. 8 illustrates a top view of a lid of the sump pump crock.
Figure 9:
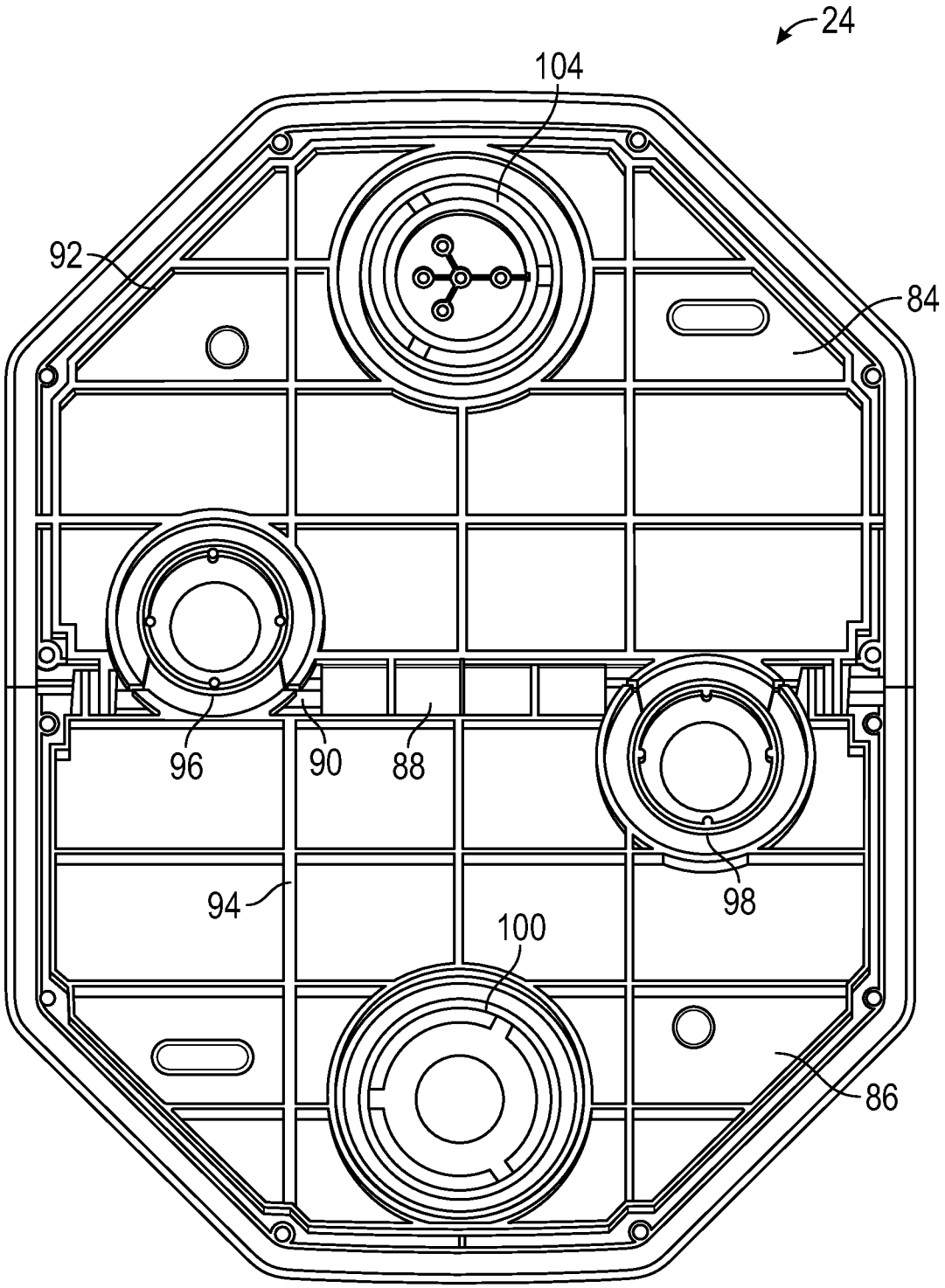
FIG. 9 illustrates a bottom view of the lid of the sump pump crock.
Figure 10:
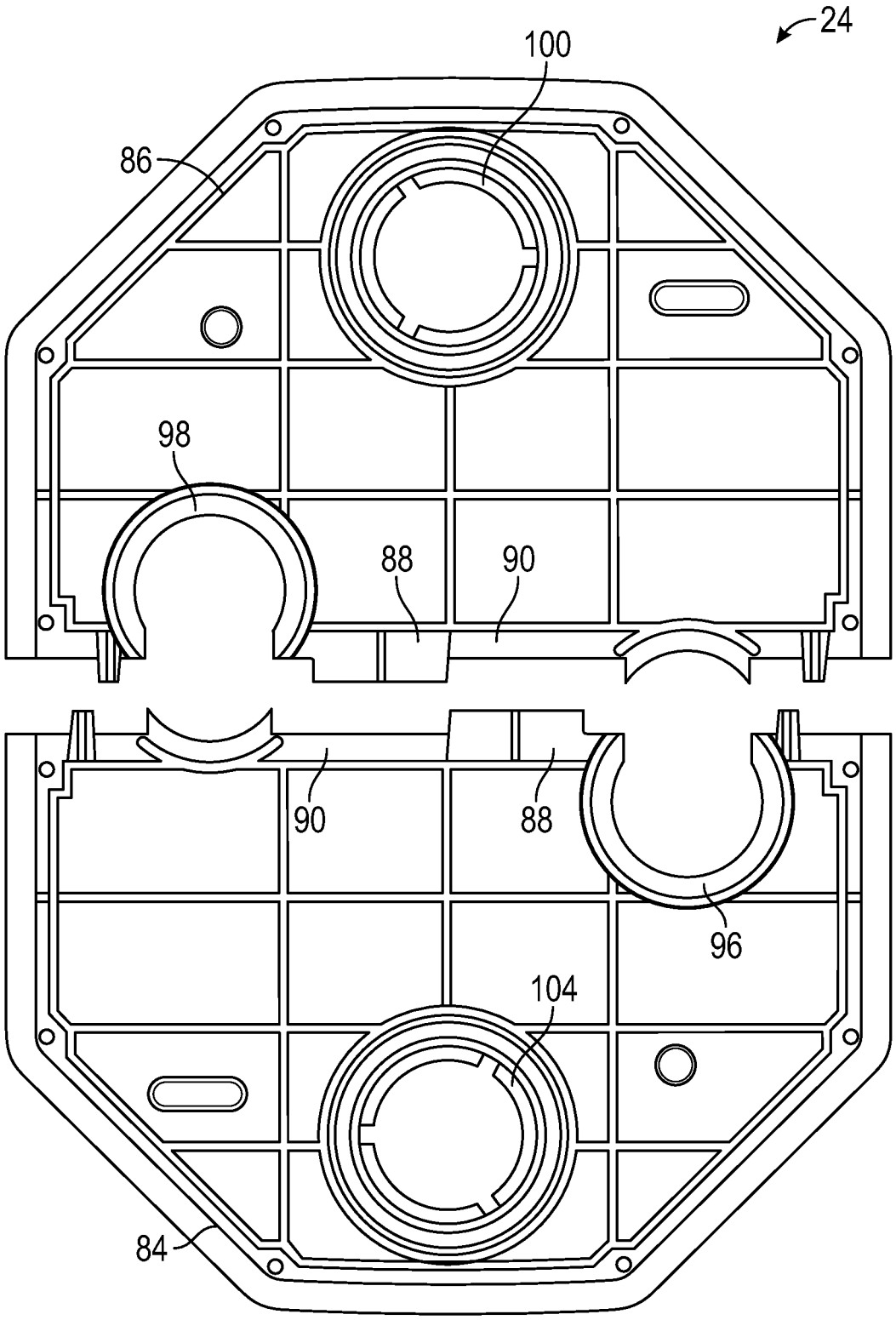
FIG. 10 illustrates a bottom view of sections of the lid of the sump pump crock separated.
Figure 11:
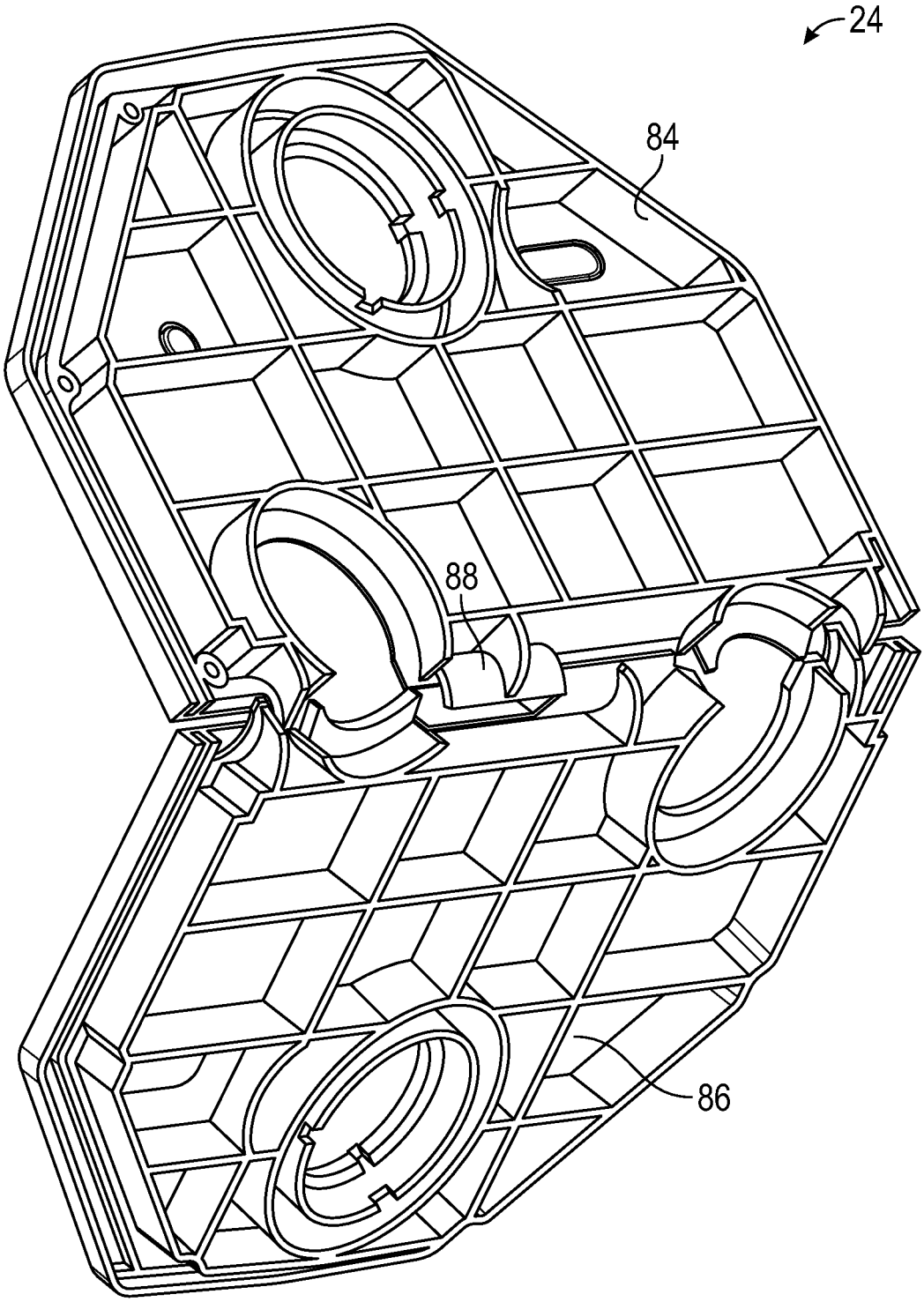
FIG. 11 illustrates a bottom view of the sections of the lid of the sump pump crock pivoted relative to each other.

As shown in FIGS. 8 and 9, the lid 24 includes a first lid portion 84 and a second lid portion 86. As shown in FIGS. 10 and 11, the first lid portion 84 and the second lid portion 86 each include a curved hinge 88 and a rod 90. The curved hinge 88 of the first lid portion 84 engages the rod 90 of the second lid portion 86, and the curved hinge 88 of the second lid portion 86 engages the rod 90 of the first lid portion 84. This allows the first lid portion 84 and the second lid portion 86 to pivot relative to each other. For example, when the lid 24 is placed over the opening of the body 12, one of the lid portions 84, 86 can be lifted by pivoting one lid portion relative to the other lid portion. In another example, one of the lid portions 84, 86 can be removed by pivoting one of the lid portions relative to the other lid portions.

The lid 24 includes a groove 92 that runs around a perimeter of the lid 24. A seal (not shown) is received in the groove 92 to provide sealing of gases. The lid 24 includes a plurality of flanges 94 to provide support. The lid 24 has a shape that corresponds to the shape of the opening 22.

The lid 24 includes a plurality of holes 96, 98, 100, and 102. A first hole 96, a second hole 98, and a third hole 100 receive a gasket/seal 102, and a tube (not shown) of a sump pump system is received in the gasket/seal 102 to provide sealing. A fourth hole 104 receives a drain 106.

Figure 12:
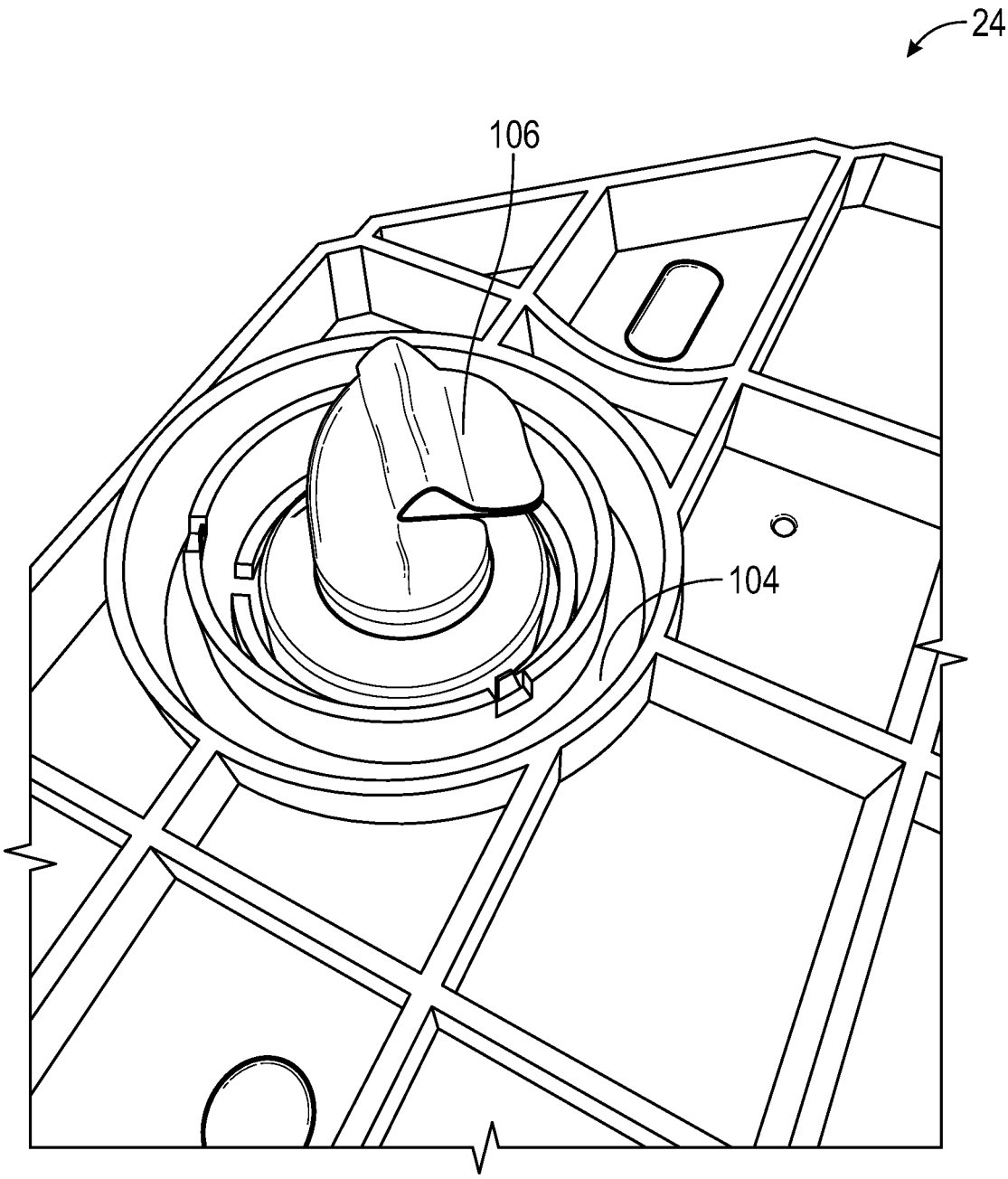
FIG. 12 illustrates a bottom view of a drain attached to the lid of the sump pump crock.

As shown in FIG. 12, the drain 106 includes a flexible body that extends into the body 12 of the sump pump crock 10 and provides a seal that allow water to flow in one direction into the body 12, but prevents bugs, rocks, etc. from entering the body 12. A rubber seal 108 with a plurality of slots 110 is received in the hole over the drain, as shown in FIG. 8.

It should be understood that many additional changes in the details, materials, steps and arrangements of parts, which have been herein described and illustrated in order to explain the nature of the present embodiments, may be made by those skilled in the art while still remaining within the principles and scope of the disclosed embodiments.

What is claimed is:

1. A sump pump crock comprising:

a body having a base and sidewalls defining a top opening, wherein the body is formed from at least a first portion and a second portion, wherein the second portion is separate from the first portion, wherein at least a first sidewall of the first portion and at least a second sidewall of the second portion defines the top opening, and wherein a plurality of flanges extend around at least a portion of an outer perimeter of the body; and a removeable lid that covers at least a portion of the top opening.

2. The sump pump crock as recited in claim 1, wherein the plurality of flanges are substantially parallel to the base.

3. The sump pump crock as recited in claim 2, wherein the plurality of flanges comprise three flanges on the first portion and the second portion.

4. The sump pump crock as recited in claim 2, wherein each of the plurality of flanges has a thickness that ranges between approximately 0.75 to approximately 1 inch.

5. The sump pump crock as recited in claim 1, wherein the body formed from at least the first portion and the second portion is octagonal in shape.

6. The sump pump crock as recited in claim 1, wherein at least one of the sidewalls includes a plurality of perforations.

7. The sump pump crock as recited in claim 1 wherein:

the first portion includes a first wall, a second wall connected to the first wall at approximately a 45° angle relative to the first wall, a third wall connected to the first wall at approximately a 45° angle relative to the first wall, a partial fourth wall connected to the second wall at approximately a 45° angle relative to the second wall, and a partial fifth wall connected to the third wall at approximately a 45° angle relative to the third wall, and the second portion includes a sixth wall parallel to the first wall, a seventh wall connected to the sixth wall at approximately a 45° angle relative to the sixth wall, an eighth wall connected to the sixth wall at approximately a 45° angle relative to the sixth wall, another partial fourth wall connected to the seventh wall at approximately a 45° angle relative to the seventh wall, and another partial fifth wall connected to the eighth wall at approximately a 45° angle relative to the eight wall.

8. The sump pump crock as recited in claim 1, wherein the first portion includes one of a tab and an opening and the second portion includes the other of the tab and the opening, and the tab is received in the opening to secure the first portion to the second portion.

9. The sump pump crock as recited in claim 8, wherein the first portion includes one of three tabs and three openings, and the other of the second portion includes the other of the three tabs and three openings.

10. The sump pump crock as recited in claim 1, further comprising:

a bridge extending between the first portion and the second portion.

11. The sump pump crock as recited in claim 10, wherein an inside surface of the first portion and an inside surface of the second portion of the body each includes a slot that receives the bridge.

12. The sump pump crock as recited in claim 1, wherein the base is formed from a first base part of the first portion and a second base part of the second portion.

13. The sump pump crock as recited in claim 1, wherein the removeable lid comprises a first lid portion and a second lid portion each including a curved hinge that engages a rod, wherein the curved hinge of the first lid portion engages the rod of the second lid portion, and the curved hinge of the second lid portion engages the rod of the first lid portion, allowing one of the first lid portion and the second lid portion to move relative to the other of the first lid portion and the second lid portion.

14. The sump pump crock as recited in claim 1, wherein the removable lid includes a hole that receives a drain that allows for water to flow in one direction through the drain.

15. A sump pump crock comprising:

a body octagonal in shape including a first portion and a second portion separate from the first portion, wherein the first portion includes one of a tab and an opening and the second portion includes the other of the tab and the opening, and the tab is received in the opening to secure the first portion to the second portion, wherein the body defines a base, a plurality of sidewalls, and a top opening, and a plurality of flanges extend around an outer perimeter of the body, extend around an external surface of the body, and are substantially parallel to the base, wherein at least one of the plurality of sidewalls includes a plurality of perforations, wherein the base comprises a first base part of the first portion and a second base part of the second portion, wherein the first base part includes one of a tab and an opening and the second base part includes the other of the tab and the opening that interacts with the one of the tab and the opening of the first base part to secure the first base part to the second base part; and a removeable lid that covers the top opening, wherein the removeable lid comprises a first lid portion and a second lid portion each including a curved hinge that engages a rod, wherein the curved hinge of the first lid portion engages the rod of the second lid portion, and the curved hinge of the second lid portion engages the rod of the first lid portion, allowing one of the first lid portion and the second lid portion to move relative to the other of the first lid portion and the second lid portion, and wherein the removeable lid includes a hole that receives a drain that allows for water to flow in one direction through the drain.

16. The sump pump crock as recited in claim 15 wherein:

the first portion includes a first wall, a second wall connected to the first wall at approximately a 45° angle relative to the first wall, a third wall connected to the first wall at approximately a 45° angle relative to the first wall, a partial fourth wall connected to the second wall at approximately a 45° angle relative to the second wall, and a partial fifth wall connected to the third wall at approximately a 45° angle relative to the third wall, and the second portion includes a sixth wall parallel to the first wall, a seventh wall connected to the sixth wall at approximately a 45° angle relative to the sixth wall, an eighth wall connected to the sixth wall at approximately a 45° angle relative to the sixth wall, another partial fourth wall connected to the seventh wall at approximately a 45° angle relative to the seventh wall, and another partial fifth wall connected to the eighth wall at approximately a 45° angle relative to the eight wall.

17. The sump pump crock as recited in claim 16 wherein one of the partial fourth wall includes one of the tab and the opening and the other of the partial fourth wall includes the other of the tab and the opening that interacts with the one of the tab and the opening to secure the one of the partial fourth wall to the other of the partial fourth wall, and wherein the one of the partial fourth wall includes three tabs and three openings, and the other of the partial fourth wall includes three tabs and three openings.

* * * * *